US010100522B2

(12) United States Patent
Beck et al.

(10) Patent No.: US 10,100,522 B2
(45) Date of Patent: Oct. 16, 2018

(54) LOW-PROFILE RAIN GUTTER SCREEN

(71) Applicants: Brian Beck, Omaha, NE (US); David R. Herdrich, Omaha, NE (US); Lance D. Bailey, Elkhorn, NE (US); Randall R. Bailey, Omaha, NE (US)

(72) Inventors: Brian Beck, Omaha, NE (US); David R. Herdrich, Omaha, NE (US); Lance D. Bailey, Elkhorn, NE (US); Randall R. Bailey, Omaha, NE (US)

( * ) Notice: Subject to any disclaimer, the term of this patent is extended or adjusted under 35 U.S.C. 154(b) by 117 days.

(21) Appl. No.: 14/329,846

(22) Filed: Jul. 11, 2014

(65) Prior Publication Data

US 2014/0318031 A1 Oct. 30, 2014

Related U.S. Application Data

(63) Continuation of application No. 13/094,708, filed on Apr. 26, 2011, now Pat. No. 8,776,444.

(51) Int. Cl.
*E04D 13/064* (2006.01)
*E04D 13/076* (2006.01)

(52) U.S. Cl.
CPC ..... *E04D 13/076* (2013.01)

(58) Field of Classification Search
CPC ..... E04D 13/076
USPC ..... 52/11–16
See application file for complete search history.

(56) References Cited

U.S. PATENT DOCUMENTS

| | | | | |
|---|---|---|---|---|
| 8,776,444 | B2 * | 7/2014 | Beck et al. | 52/12 |
| 2008/0190040 | A1 * | 8/2008 | Graves | 52/12 |
| 2011/0041414 | A1 * | 2/2011 | Bell | 52/12 |
| 2011/0162289 | A1 * | 7/2011 | Cangialosi | 52/12 |
| 2011/0283630 | A1 * | 11/2011 | Beckham et al. | 52/12 |
| 2012/0151849 | A1 * | 6/2012 | Brochu | 52/12 |

* cited by examiner

*Primary Examiner* — William V Gilbert
(74) *Attorney, Agent, or Firm* — Dax D. Anderson; Kirton McConkie

(57) ABSTRACT

A low-profile screen which allows water to pass through apertures formed therein to allow water to drain through the screen. A plurality of ridges are formed on the surface of the screen to allow water to drain at a number of different elevations, to increase the structural rigidity of the screen, to improve snow-melting, and to improve the screens reliance when compressive forces are exerted on the screen. Under compression the screen snaps into place. The ridges further promote debris being blown off of the surface of the screen.

20 Claims, 6 Drawing Sheets

LOW-PROFILE RAIN GUTTER SCREEN

RELATED APPLICATIONS

This application is a Continuation of U.S. patent application Ser. No. 13/094,708, filed Apr. 26, 2011.

BACKGROUND

1. Field of the Invention

Exemplary embodiments relate to an apparatus comprising a low-profile gutter screen that prevents leaves and other debris from entering a rain gutter. Certain exemplary embodiments relate to a rain gutter screens having a plurality of aperture water drains formed in the screen so as to permit rain water to flow into the gutter while simultaneously preventing debris from entering the gutter.

2. Background and Related Art

Many residential and commercial buildings utilize rain gutters as a means of channeling the flow of rain water. When properly functioning, rain gutters positioned on roof-lines prevent erosion to both the ground and other surfaces, keep building patrons dry and also reduce the formation of ice in cold climates.

However rain gutters malfunction when filled with debris such as leaves which can be blown onto a roof. Debris can accumulate in gutters to form dams within the rain gutter or a down spout. Such dams can cause water to pool and overflow the rain gutter. In addition the pooled water can freeze, thus adding substantial weight to the gutter. This additional weight can deform attachments and supports connecting the gutter to the building thus causing the gutter's grade to be significantly changed, thus allowing even more pooling. In addition the additional stress on the drain supports can cause the supports to pull away from the building, thus allowing water to enter, freeze and cause additional damage. Similar problems occur when the water in a downspout freezes.

Preventative measures have been utilized to help reduce the formation of dams and in turn building damage. As a result rain gutter covers have been employed to reduce the accumulation of debris in the rain gutters. This is accomplished by channeling the debris across the length of the gutter and shedding the debris to the ground. Some of the water adheres to the surface of the shield through surface tension and drains into the gutter.

Problems still exist. Some shields fail to function properly in anything other than optimal conditions.

Finally, installation of some rain gutter covers requires large equipment and tools such as a hand brake or siding brake to bend the rain gutter cover to match the angle between the roof pitch and the plane created by the rain gutter's top.

BRIEF SUMMARY OF THE INVENTION

Features of an exemplary embodiment include a system for straining debris from water flowing off a roof top by providing a low-profile screen comprising a plurality of drains or apertures. The drains or apertures may be provided in a ridged surface that facilitates drainage of the water as well as automatic removal of any caught debris by wind.

BRIEF DESCRIPTION OF THE SEVERAL VIEWS OF THE DRAWINGS

The objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF THE INVENTION

A description of embodiments of the present invention will now be given with reference to the Figures It is expected that the present invention may take many other forms and shapes, hence the following disclosure is intended to be illustrative and not limiting, and the scope of the invention should be determined by reference to the appended claims.

The term low-profile comprises a gutter screen which fits on top of a gutter where the screen lies generally between the front and back of the gutter and below the front lip of a gutter. The screen portion of the low profile screen is generally not visible unless a viewer is looking down into the gutter.

The term gutter is defined as a rain gutter affixed at the bottom edge of a roof and that catches rain water run-off.

Pitch is defined as the angle of the screen in relation to the ground.

The term "hand adjustable" or "hand manipulable" means the angle at which the shield may be bent or may be manipulated or adjusted by hand so as to conform to the angle formed by the pitch of the roof and the plane created by the top of the rain gutter.

The term snap comprises the screen being inserted between the two structures, including the building and the front of the gutter or the two outside edges of the gutter so as to place a compression force on the screen.

Figure 1:
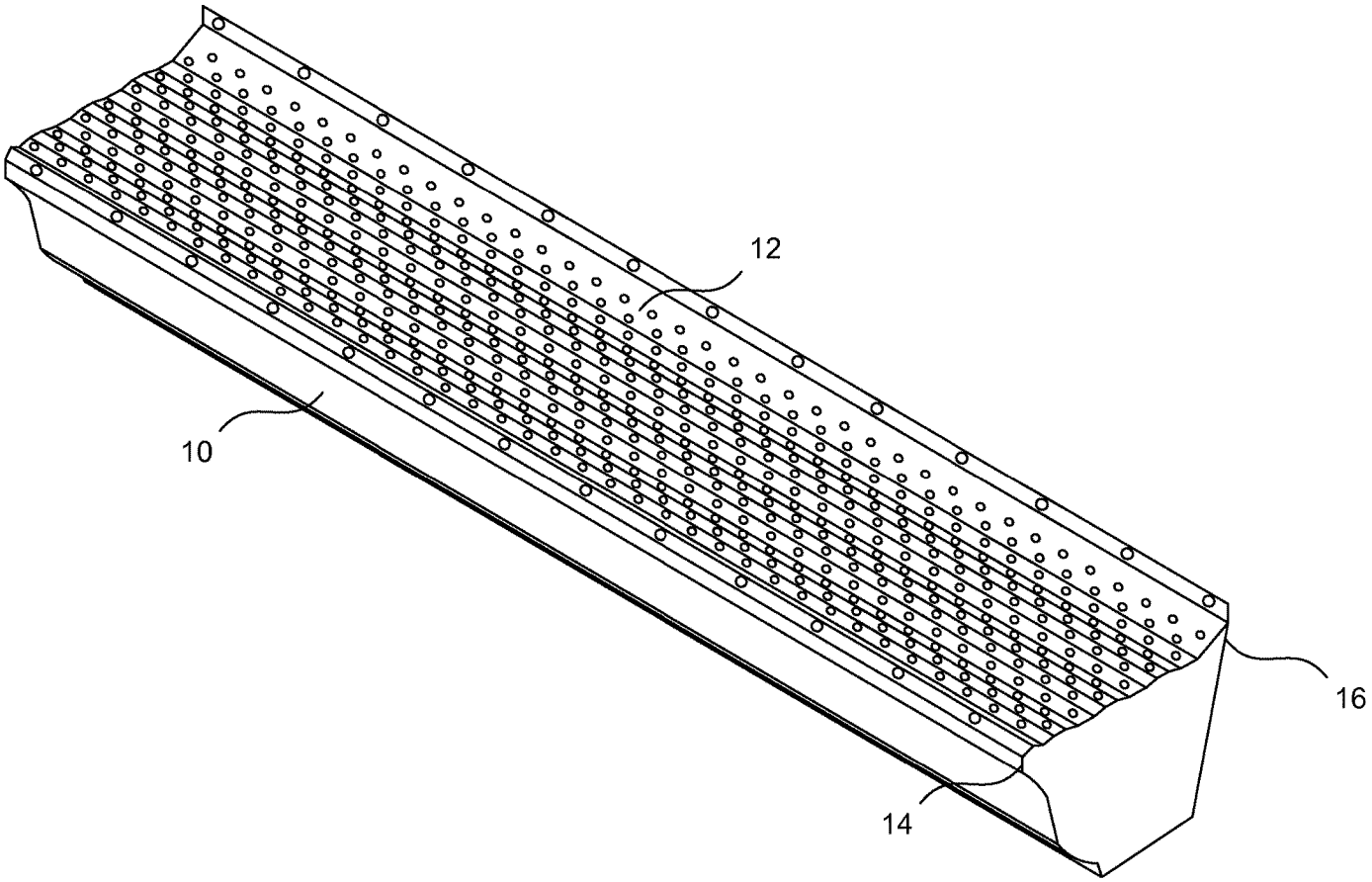
FIG. 1 illustrates an exemplary embodiment of gutter and screen.

FIG. 1 illustrates an exemplary embodiment of a gutter screen and gutter combination. The combination includes a gutter 10 that is essentially similar to or identical to known gutters commonly used to catch and divert rain water run-off from a roof during a rain storm. As is known, rain gutters such as gutter 10 catch water and diverts it to a desired location such as a down spout or other advantageous area where the water does not fall on an underlying surface and cause unwanted erosion or other damage to a structure or the underlying surface.

Figure 2:
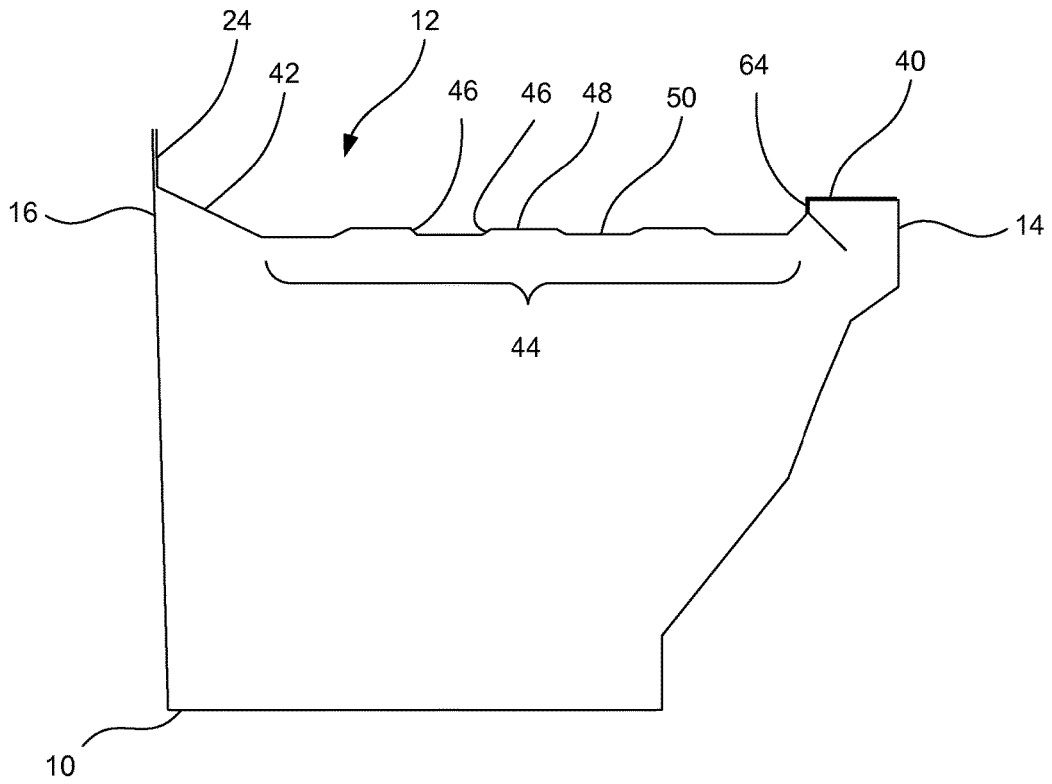
FIG. 2 illustrates a cross view of an exemplary embodiment of a gutter and screen.

In the exemplary embodiment illustrated in FIG. 1 a screen 12 lies on top of the gutter 10 between a front lip 14 and a back lip 16 of the gutter. The back lip 16 is typically positioned near the structure to which the gutter 10 is affixed, and the front lip 14 is positioned away from a structure to which the gutter 10 is affixed. FIG. 2 shows a cross-sectional view of the gutter screen and gutter combination shown in FIG. 1, illustrating an exemplary relationship between the illustrated embodiments of the gutter 10 and the screen 12.

Figure 3:
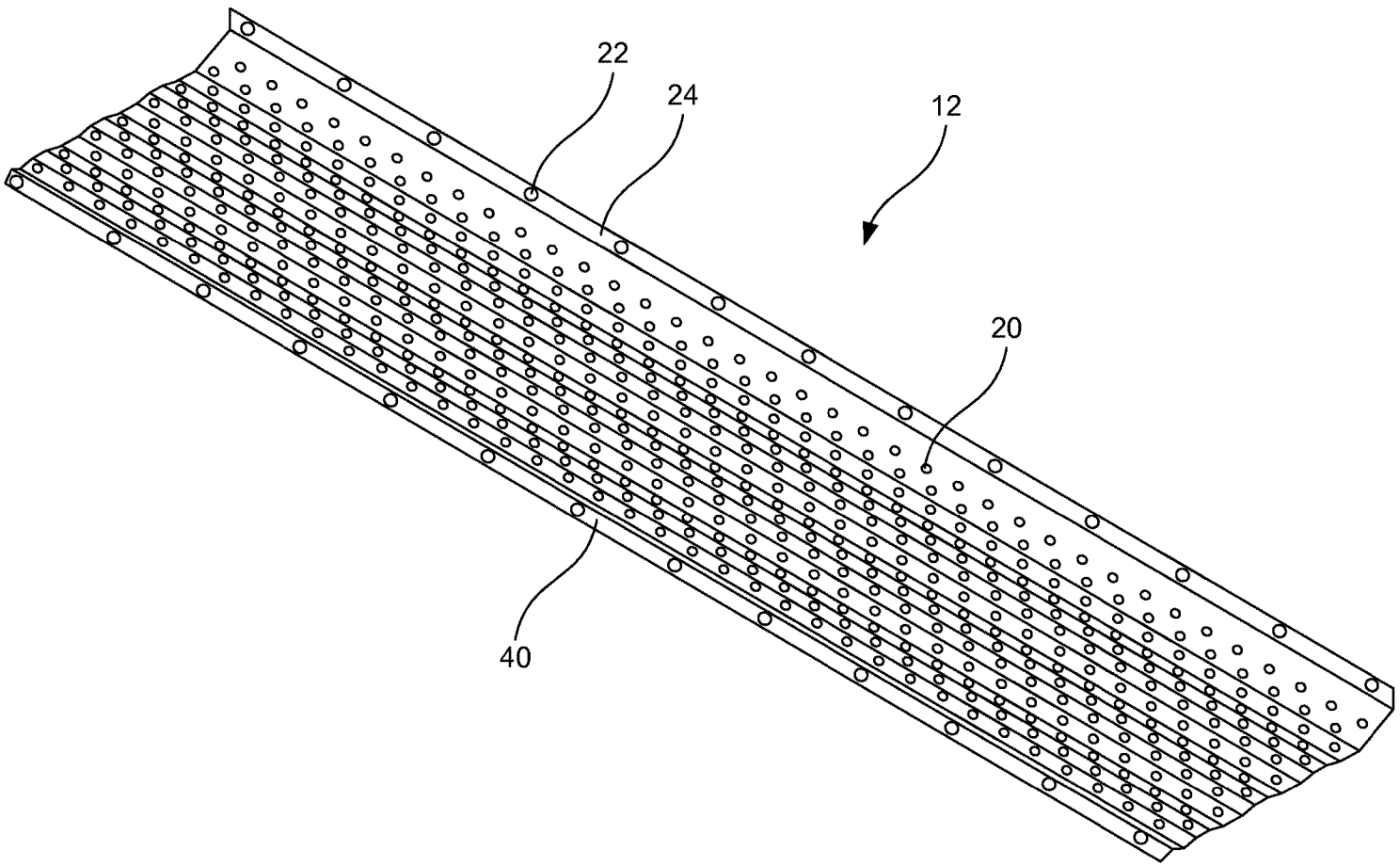
FIG. 3 illustrates of an exemplary embodiment screen.

FIG. 3 illustrates an exemplary embodiment of the screen 12 separated from the gutter 10. As may be seen in FIG. 3, the screen 12 includes a plurality of apertures 20 to allow draining of water which may flow onto the screen 12. The screen 12 further comprises a plurality of pilot holes 22 that pierce a back mating surface 24. The pilot holes 22 may be spaced apart in a variety of ways and may be circular to accommodate a single screw or similar fastener, as shown in FIG. 3. Alternatively, the pilot holes 22 may be made oval in shape, with a long axis oriented along the length of the screen 12 to permit the screen 12 to slide back and forth to some extent, as desired. Permitting the screen 12 to slide laterally or side-to-side across the top of the gutter 10, for example, might permit the user or installer to adjust the placement of the screen 12, or similarly allow some access to the underlying gutter 10 without having to remove the entire screen 12.

The apertures 20 may be varied in shape and size, and can be spaced to permit maximum draining of any water that may fall on the surface of the screen 12. An objective of the aperture placement is to permit maximum draining in minimal time. Not only will quick draining of water from the surface of the screen 12 accommodate large amounts of rainfall, but it will also permit any debris which comes to rest on the screen 12 to dry quickly and blow away off the screen 12, as will be discussed in more detail with respect to FIG. 6.

Figure 4:
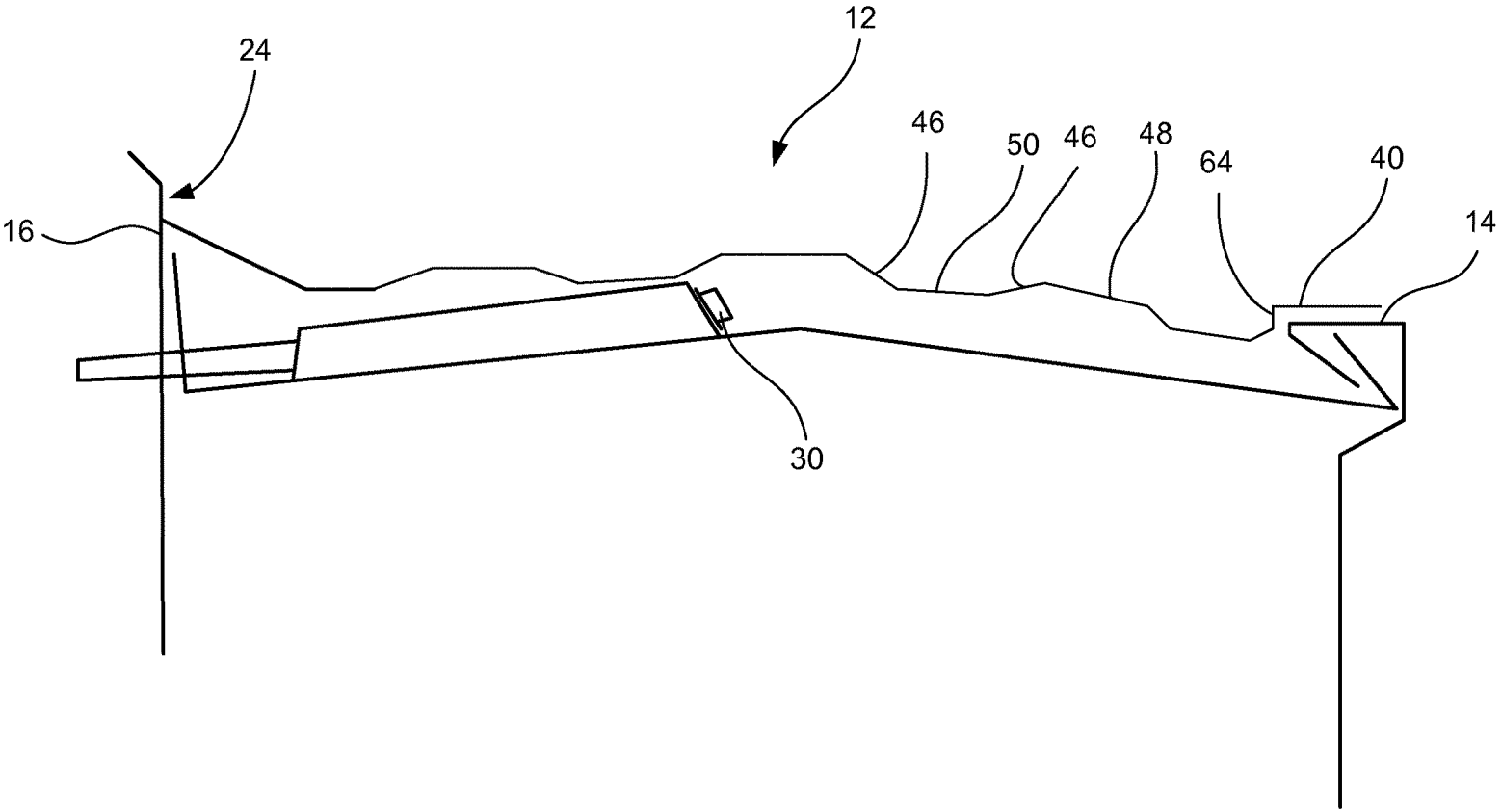
FIG. 4 illustrates a detailed view of an alternative exemplary embodiment of the screen in connection with a gutter.

FIGS. 2 and 4 show cross-sectional views of alternative gutter screen and gutter combinations. The primary difference between the combinations illustrated in FIGS. 2 and 4 is the use of an upwardly protruding gutter fastener 30 in the combination of FIG. 4. The gutter fastener 30 may be any fastener or fastener system used to attach gutters such as gutter 10 to structures, including screws and screw systems. The gutter fastener 30 of FIG. 4 engages the front lip 14 as shown and extends through the back lip 16 into the underlying structure. Of important note, the gutter fastener 30 includes portions that extend somewhat above the uppermost portion of the front lip 14 of the gutter, such that placing a planar screen on the gutter 10 to rest at the level of the front lip 14 is inhibited. Instead, the screen 12 may be bent or flexed as shown in FIG. 4 to accommodate the gutter fastener 30 underneath the screen 12 without impairing the function of the screen 12.

Figure 5:
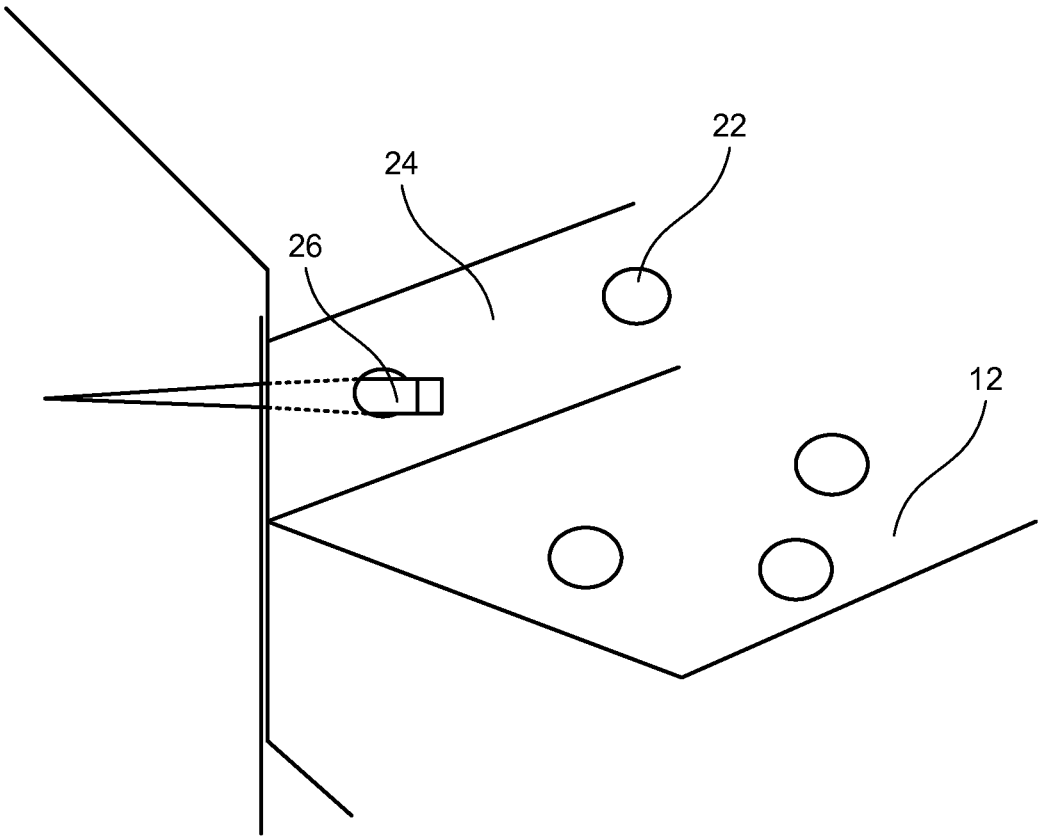
FIG. 5 illustrates an alternative exemplary embodiment of the screen connected to a structure.

As shown in FIGS. 2 and 4, the gutter 10 supports or is connected to the screen 12 at the front lip 14 and the back lip 16. The back mating surface 24 may rest flat against a fascia board, a drip edge or other structure that is part of a structure to which the gutter 10 is affixed such as a house, or against the back lip 16 of the gutter 10. The back mating surface 24 may be attached to the structure such as by placing screws 26 or other fasteners through the pilot holes 22, as shown in FIG. 5. Increasing the number of screws 26 attaching the screen 12 to the structure provides strength and support to the screen 12 and may also strengthen an attachment of the gutter 10 to the structure if the screws 26 or other fasteners pass through the gutter 10. Essentially, the screws 26 or other fasteners act as a secondary hanging system for the gutter 10 in such installations.

In addition, the use of the screws 26 or other fasteners to attach the screen 12 at the back mounting surface 24 and independently of the installation of the gutter 10 in this way permits an installer to vary the pitch of the screen during installation of the screen 12. Controlling the pitch of the screen 12 allows varying the installation of the screen 12 to improve function of the screen 12 according to anticipated circumstances of use of the screen 12. For example, in situations where unusually heavy debris is anticipated (e.g. where many deciduous trees are present), the installer may decide that a slight down pitch (away from the structure) of the screen 10 would shed more debris than a perfectly level installation. Alternatively, in areas of unusually heavy water flow, the installer may decide that a slight back pitch (toward the structure) would better control water flowing off the structure's roof by acting to better interrupt or slow down the flow of water from a roof of the structure.

The exemplary gutter screen and gutter combinations illustrated by FIGS. 1 through 4 show specific potentially-advantageous features of the screen 12. Starting from the back mating surface 24 and moving towards a front portion 40 of the screen 12, a sloped portion 42 of the screen 12 extends from the back mating surface 24. The sloped portion 42 is sloped so that debris will not rest near the structure, but will instead be moved toward the front portion 40 of the screen 12. Moving any debris towards the front portion 40 allows the debris to more easily blow off the screen 12.

In the illustrated embodiments, the sloped portion 42 has fewer apertures 20 per unit area than portions of the screen in between the sloped portion 42 and the front lip 42. This promotes water flow over the top of the screen 12 to help flush any debris that may be resting on the sloped portion 42 towards the front of the gutter 10, where it can more easily be blown off. In certain alternative embodiments, the apertures 20 are formed with a similar frequency and size all the way to the edge of the back mating surface 24 while in other embodiments no apertures 20 are provided on the sloped portion 42. The appropriate embodiment employed can be varied to satisfy the demands of the particular environment of installation. For example, one alternative embodiment of a screen 12 with greater number of apertures per unit area in the sloped portion 42 may be used in areas of high rainfall. The screen 12 with more apertures in the sloped are 42 may be used to increase draining. In contrast, if debris is a primary concern, a panel with fewer or no apertures 20 formed on the sloped portion 42 may be used to improve flushing the debris to the front of the gutter 10 and away from the structure during water flow.

The sloped portion 42 provides additional advantages including permitting the slope or angle of the sloped portion 42 to be adjusted to allow the effective width of the screen 12 to be modified. Modification of the effective width of the screen 12 may permit compatibility with a variety of gutter widths, and with at least some embodiments may be accomplished by hand at the site of installation. An illustration may include bending the sloped portion 210 to be closer to horizontal, thereby making the effective width of the screen 12 wider. By increasing the effective width of the screen 12, a screen 12 primarily designed for five-inch gutters can be effectively used in connection with gutters wider than, for example, the standard five inches. Alternatively, if a gutter is narrower than the standard five inch gutter, the sloped portion 42 can be bent up or down to make the effective width of the screen 12 narrower. With certain embodiments of the screen 12, the sloped portion 42 may be bent both up or down to reduce the effective width of the gutter cover. Also, the screen 12 may be bowed up or down along any portion of the screen 10 to permit compatibility with a variety of gutter widths. Certain embodiments provide hand adjustability in manipulating the width of the screen 12 so that any portion of the screen 12, such as the sloped portion 42 may be adjusted by hand.

As shown in FIGS. 1-4, certain embodiments of the screen 12 include a ridged surface 44 having a plurality of faces 46 and ridge tops 48 separated by channels 50. The ridged surface 44 of the screen 12 allows the screen 12 to drain water regardless of the angle at which the screen 12 is installed. Thus if the screen 12 is installed with an upward pitch to help control high water flow from the structure's roof, the ridged surface 44 provide a plurality of angled surfaces to direct water flow to the channels 50. Similarly, if the screen 12 is installed utilizing a downward pitch the plurality of angles again directs the water to the channels 50. The same principles control water flow and draining if the screen 12 is bowed to fit a narrower gutter 10 trough, such that a portion of the screen 12 is upwardly pitched and a portion is downwardly pitched. The ridged surface 44 also allows water to drain into the holes even if the panel is installed other than perfectly level. Although the embodiments illustrated in FIGS. 1-4 illustrate certain numbers of ridge tops 48 and channels 50, it should be understood that differing amounts of ridge tops 48 and channels 50 may be used in other embodiments.

Embodiments of the screen 12 having the ridged surface 44 provide additional advantages beyond the capture of water leaving the roof by way of interrupting the outward flow of water. For example, in certain embodiments, the apertures 20 are placed on several aspects or surfaces of the ridged surface 44, as may be appreciated from FIGS. 1-4. For example, in the illustrated embodiments the apertures 20 are placed on the ridge tops 48, as well as on each of the faces 46 adjacent each ridge top 48 and in the channels 50. The placement of apertures in these locations allows water to drain even if the channels 50 are clogged.

Figure 6:
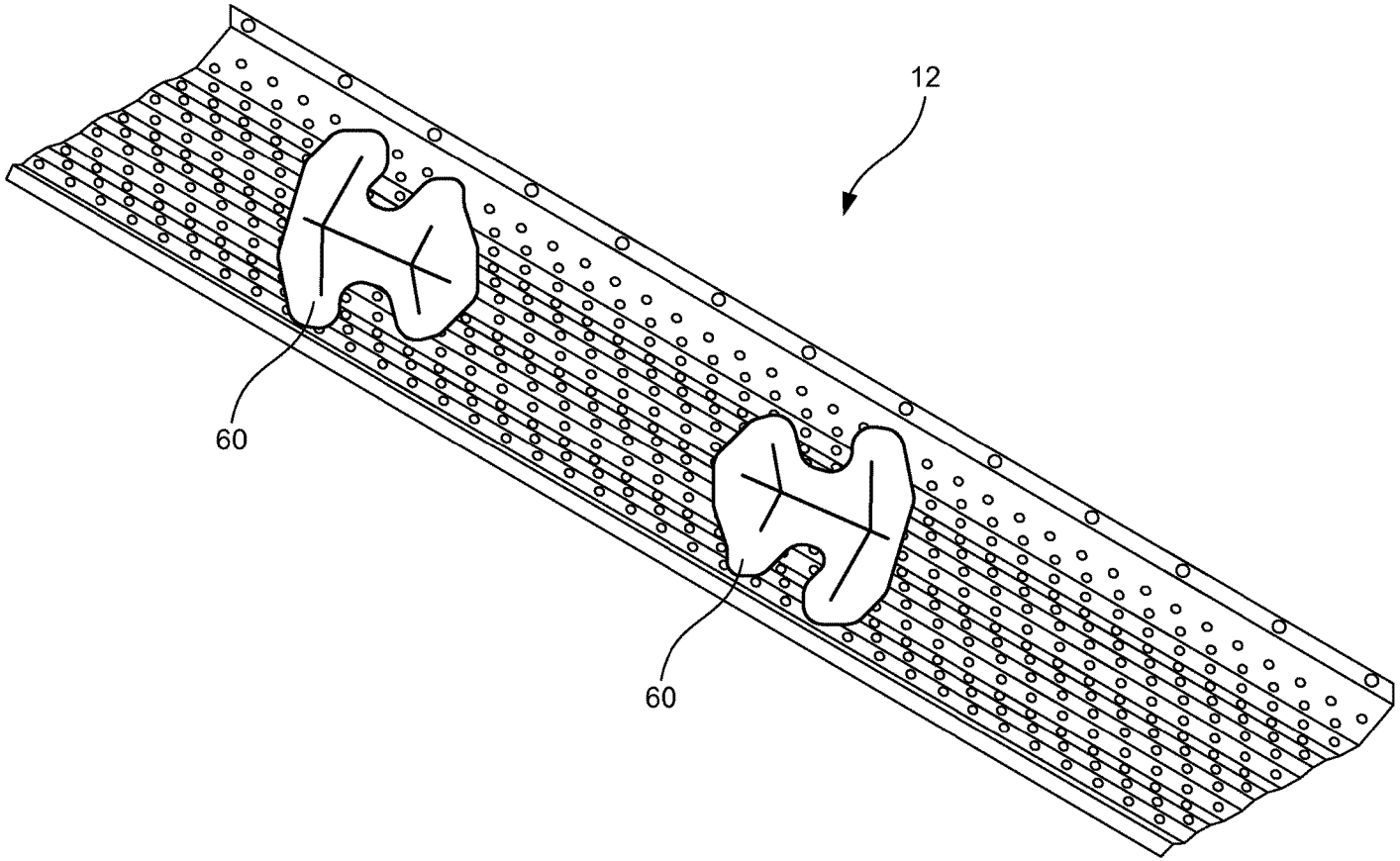
FIG. 6 illustrates a top view of an alternative exemplary embodiment showing debris resting on a screen.

Additionally, the ridged surface 44 provides different planes and angles that allow debris which may fall onto the panel to be carried off by the wind. The ridged surface 44 creates varying relief which allows airflow across the surface of the screen 12 to dry and lift even heavy wet debris, the ridges forming air foils which create turbulence and spaces underneath the debris to facilitate lifting of the debris from the surface. Thus, as shown in FIG. 6, not only does the screen 12 prevent debris 60 from entering and clogging the gutter 10 by at least trapping the debris 60 on the surface of the screen, the features of the screen 12 facilitate automatic removal of the debris 60 from the screen 12 in multiple ways, first by the action of water passing over the screen 12, such as coming down the sloped portion 42, second by the action of the ridged surface 44 which prevents the debris from contacting the screen on all surfaces and being trapped by a film of water around the debris 60 through the water's surface tension, and third by the action of the ridged surface 44 that allows airflow underneath the debris 60 that tends to dry the debris 60 and also to cause the debris 60 to be more easily blown away.

Furthermore, the ridge of the ridged surface 44 give the screen 12 increased structural rigidity to help support any load, such as snow, ice, or debris, which may be placed thereon. The faces 46 may aid in melting snow and ice faster because of the increased surface area exposed to sunlight.

In addition, as discussed above, the ridges of the ridged surface 44 may facilitate bending of the screen 12 slightly in order to be installed over protruding gutter hangers or other fasteners, as shown in FIG. 4. This ability to bend or bow permits the screen 12 to be used with a variety of gutters and gutter hanging systems and both as a new system and as a retro-fit system.

Certain embodiments of the screen 12 include the front portion 40 that may incorporate an angle which promotes debris blowing off the screen 12. In addition, the front portion 40 in some embodiments further may include apertures similar to or identical to apertures 20 to permit water that may reach the front of the screen 12 to drain off the surface of the screen 12 into the gutter 10 below. The front portion 40 in some embodiments also incorporates a small vertical section 64 that acts as a positive stop to further prevent water from flowing off the front of the screen 12. The vertical section 64 on the front of the screen 12 may extend to approximately the height of the gutter's front lip 14, thus the height of the vertical section 64 may depend on how recessed the screen 12 is in the trough of the gutter 10. In addition, the vertical section 64 may be formed to mate with the front lip 14 of the gutter 10 so that the screen 12 can be installed by snapping the screen 12 into place. The snapping action utilizes a compression force imposed between the sloped portion 42 and the front portion 40. The compression force secures the screen 12 in place in some embodiments and improves the efficiency of installing the screen 12 when screws or other fasteners are placed through pilot holes in the front portion 40 of the screen 12 and into the front lip 14 of the gutter. In one embodiment, pilot holes are located approximately every two inches along the front portion 40 to permit an installer to make the attachment as secure as desired or to have an attachment point anywhere deemed necessary.

Certain embodiments involve installation of the screen 12. One exemplary method of using the screen 12 involves, working from one end of the gutter 10 or the other, an installer who takes a first section of screen 12, tilts the back mating surface 24 into a gutter 10 and places the back mating surface 24 onto the structure's fascia board or drip edge. The installer may then snap the front of the screen 12 into place so that the front portion 40 is substantially flush, or may become flush against front lip 14 of the gutter 10. If necessary to accomplish this step, the installer may bend or flex the ridged surface 44 or the sloped portion 42 or both of the screen 12 so the effective width of the screen 12 matches the width of the gutter's trough.

The installer may then attach the front portion of the screen 12 to the gutter 10 using two zip screws, one on the beginning end of the screen 12 and one in the middle. The screws might be placed in pilot holes located along the front portion 40 of the screen 12. The installer may then attach the back mating surface 24 of the screen 12 to the structure including the structure's fascia board or drip edge using two zip screws, such as about a foot from either edge.

The installer may then take a second section of the screen 12 and place it on the gutter 10 so that one edge of the second section of screen 12 overlaps the ending edge of the first section of screen 12 until the last pilot hole of the first panel is aligned with the first pilot hole of the second. The second section of screen 12 is snapped into place in a similar fashion to that discussed above and a zip screw is then inserted into the aligned pilot holes to secure both panels through this hole. This process is repeated using two screws to attach each of the front and the back of the sections of screen 12 into the gutter 10 front lip 14 and the fascia board/drip edge and overlapping the sections of screen 12 by at least the first pilot hole on the seams in front.

When the installer reaches a corner, a miter panel may be placed to fit inside and outside comers leaving a length of miter to overlap each section of the screen 12 to improve the strength of the conjunction between the screen and the miter.

Embodiments of the invention may be manufactured of any material having suitable characteristics to perform the functions discussed herein. For example, the screen 10 may be formed of materials similar to those used for existing gutters, including aluminum, vinyl and the like. As may be seen from the Figures, each section of the screen 12 may be formed from a sheet of material that is bent, thermoformed, or otherwise formed into the desired profile, such as the cross section shown in FIG. 2. The apertures 20 and/or pilot holes 22 may be formed in the sheet of material either before or after the sheet is bent, thermoformed, or otherwise formed into the desired profile.

As may be appreciated from the above discussion and the accompanying figures, the appearance from below of a gutter screen and gutter combination may be essentially identical to the appearance of a standard gutter without a screen from below. Only upon viewing from above would the screen 12 normally become visible. As such, the screen 12 is low profile, and may be formed of or coated in a material that may differ in appearance from that of the gutter 10. For example, the screen 12 may be formed of or coated with a dark color material such that it better absorbs the sun's light to improve melting of ice and/or snow as well as drying of wet debris 60, even if the gutter 10 is made of or coated with a light-colored material.

The present invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed and desired to be secured by Letters Patent is:

1. A gutter screen configured to sit within a cavity formed by a gutter, the gutter screen comprising: a body comprising a back mating surface, a sloped planar surface extending obliquely from a bottom of the back mating surface, a screen portion defining a plane and a front portion edge, wherein the front portion edge of the gutter screen is configured to attach to a front edge of the gutter and the back mating surface is configured to attach below a back edge of the gutter to allow the body to sit within the cavity formed by the gutter, and wherein the back mating surface comprises a planar terminal end distal relative to the sloped planar surface, wherein the sloped planar surface comprises a first longitudinal edge connecting the sloped planar surface to the bottom of the back mating surface and a second longitudinal edge connecting the sloped planar surface to a first edge of the screen portion.

2. A gutter screen as recited in claim 1, further comprising a downwardly sloping section that is flexible and wherein the gutter screen is wider than the cavity formed by the gutter, so that when the screen is placed in the cavity formed by the gutter the screen is spring-loaded so as to simultaneously push the front portion edge of the screen against the front edge of the gutter and the back mating surface against the back edge of the gutter.

3. A gutter screen as recited in claim 1, further comprising ridges.

4. The gutter screen of claim 3, wherein the ridges comprise flat ridge tops flanked on both sides by faces and wherein the faces are connected by flat channels.

5. The gutter screen of claim 4, wherein the flat ridge tops comprise apertures.

6. The gutter screen of claim 3, wherein the ridges are configured to permit debris to dry and be blown away by wind.

7. The gutter screen of claim 3, wherein the ridges are configured to allow water to drain regardless of an angle of the body.

8. A gutter screen as recited in claim 1, further comprising apertures in the surface of the gutter screen.

9. A gutter screen as recited in claim 1, wherein the gutter screen is configured to be selectively positioned within the cavity of the gutter.

10. The gutter screen of claim 1, wherein the back mating surface further comprises pilot holes configured to receive the fasteners.

11. The gutter screen of claim 10, wherein the pilot holes are oval-shaped to permit adjustment of the gutter screen during installation.

12. The gutter screen of claim 1, wherein the body is configured to be hand-adjustable without tools to modify an effective width of the gutter screen to permit compatibility with a variety of gutter widths.

13. The gutter screen of claim 1, wherein the body is configured to be hand-adjustable without tools to allow the body to be bent or flexed to permit installation of the gutter screen over upwardly protruding gutter fasteners.

14. The gutter screen of claim 1, wherein the sloped portion comprises apertures.

15. The gutter screen of claim 1, wherein the front portion further comprises a small vertical section configured to mate with a front lip of the gutter to permit the gutter screen to snap into place on the gutter.

16. The gutter screen of claim 15, wherein the section is configured to act as a positive stop to reduce water flow over the front portion.

17. The gutter screen of claim 1, wherein the body further comprises a dark colored material to promote one or more of ice melting, snow melting, or drying debris.

18. A low profile gutter screen comprising: a body comprising a back mating surface, a planar sloping surface extending obliquely from a bottom of the back mating surface, a screen portion defining a plane and a front edge, wherein the front edge is configured to attach to a front edge of a gutter, wherein the back mating surface further comprises a planar terminal end distal relative to the planar sloping surface that is configured to be attached below a back edge of the gutter to allow the front edge and the distal terminal edge of the back mating surface to sit within a cavity formed by the gutter, wherein the back mating surface is parallel with a back lip of the gutter, and wherein the planar downward sloping surface comprises a first longitudinal edge connecting the planar downward sloping surface to the bottom of the back mating surface and a second longitudinal edge connecting the planar sloping surface to the screen portion.

19. A gutter screen as recited in claim 18, further comprising a sloped portion which allows the back mating surface to be extended or compressed in varying amounts such that the back mating surface can be selectively positioned within the cavity formed by the gutter.

20. A gutter screen comprising: a primary body defining a plane, the primary body comprising a back mating surface, a planar sloped surf ace extending obliquely from a bottom of the back mating surface, and a front edge; wherein the primary body is configured to sit within the cavity formed by a gutter, wherein the back mating surface comprises a planar terminal end distal relative to the planar sloped surface and wherein the planar sloped surface comprises a first longitudinal edge connecting the planar sloped surface to the bottom of the back mating surface and a second longitudinal edge connecting the planar sloped surface to the plane of the primary body.

* * * * *